US005409266A

United States Patent [19]

Baker

[11] Patent Number: 5,409,266

[45] Date of Patent: Apr. 25, 1995

[54] ADJUSTABLE ROOF JACK

[75] Inventor: George C. Baker, Glendale, Ariz.

[73] Assignee: Skyline Metal Products, Inc., Phoenix, Ariz.

[21] Appl. No.: 212,915

[22] Filed: Mar. 15, 1994

[51] Int. Cl.[6] ..... E04D 13/147

[52] U.S. Cl. ..... 285/44; 285/184; 285/424; 52/199; 52/219; 52/60; 454/254

[58] Field of Search ..... 52/199, 198, 126.2, 52/219, 60; 285/42, 43, 44, 183, 184, 185, 424; 454/254, 275, 338; 138/DIG. 8

[56] References Cited

U.S. PATENT DOCUMENTS

| | | | |
|---|---|---|---|
| 917,385 | 4/1909 | Wallace . | |
| 1,192,279 | 7/1916 | Dawson . | |
| 1,209,043 | 12/1916 | Scherer | 285/424 X |
| 1,332,224 | 3/1920 | McHale . | |
| 1,703,670 | 2/1929 | Hoeft . | |
| 2,324,928 | 7/1943 | Hill | 285/184 X |
| 3,082,677 | 3/1963 | Pease | 285/44 X |
| 3,742,659 | 7/1973 | Drew | 285/44 X |
| 4,526,091 | 7/1985 | Sharp . | |
| 4,781,401 | 11/1988 | Sharp . | |
| 4,843,794 | 7/1989 | Holtgreve . | |
| 4,893,608 | 1/1990 | Reasor . | |
| 4,895,066 | 1/1990 | Carnahan | 454/275 X |
| 4,937,991 | 7/1991 | Orth | 52/199 |

*Primary Examiner*—Carl D. Friedman
*Assistant Examiner*—Laura A. Saladino
*Attorney, Agent, or Firm*—LaValle D. Ptak

[57] ABSTRACT

An adjustable roof jack interconnects a roof-mounted air handler with a duct opening through the roof of a building in a full range from flat to a 6-in-12 pitch; so that a single roof jack is capable of use in substantially all standard construction. To accomplish this, the roof jack includes a lower rectangular box-like member, which is attached to the roof. An upper rectangular box-like member is made for attachment to a roof-mounted air handler; and the front and sides of the upper box-like member extend downwardly over the corresponding side and front of the lower roof-mounted member. The upper member is pivotally connected to the lower member at pivot points located through the sides intermediate the front and back of the two members. The front of the members faces the center or higher portion of the roof; and the edge of the front of the upper member is folded into an "S" configuration; so that the upper edge of the front of the lower member extends into a pocket in the "S" configuration to provide a sliding seal between the two parts as the upper member is pivoted relative to the lower member to accommodate the roof pitch.

14 Claims, 2 Drawing Sheets

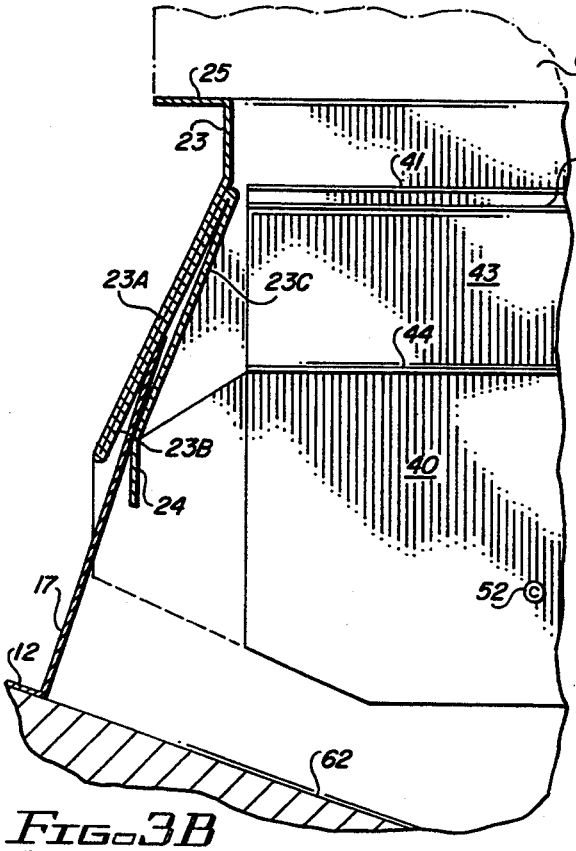
FIG. 3B
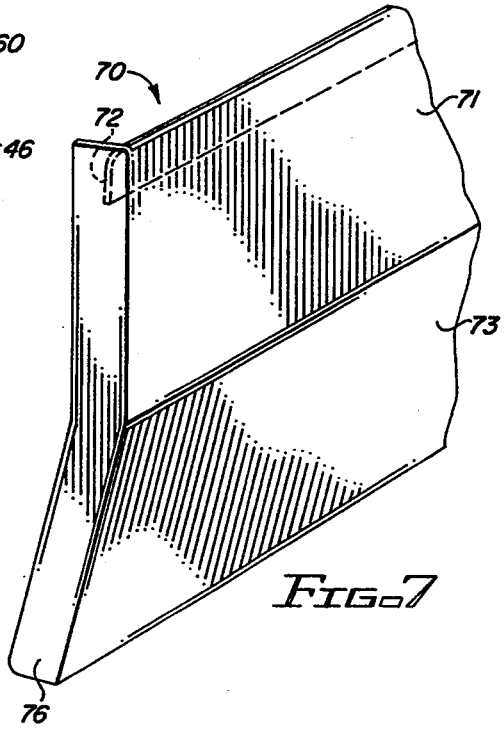
FIG. 7
FIG. 8
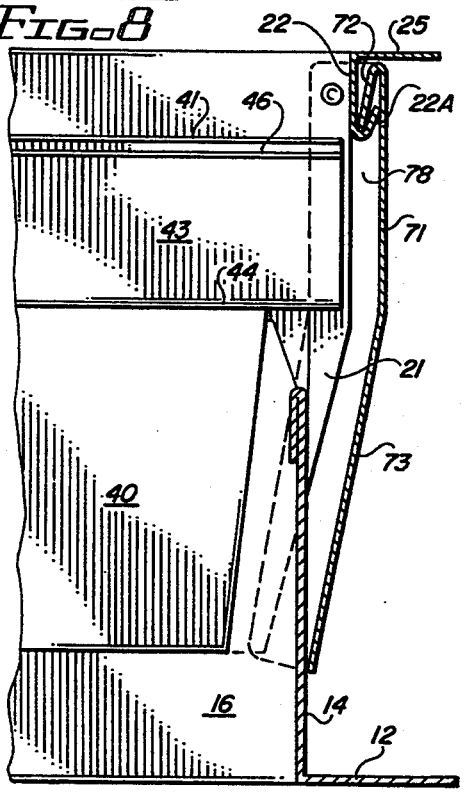
FIG. 6
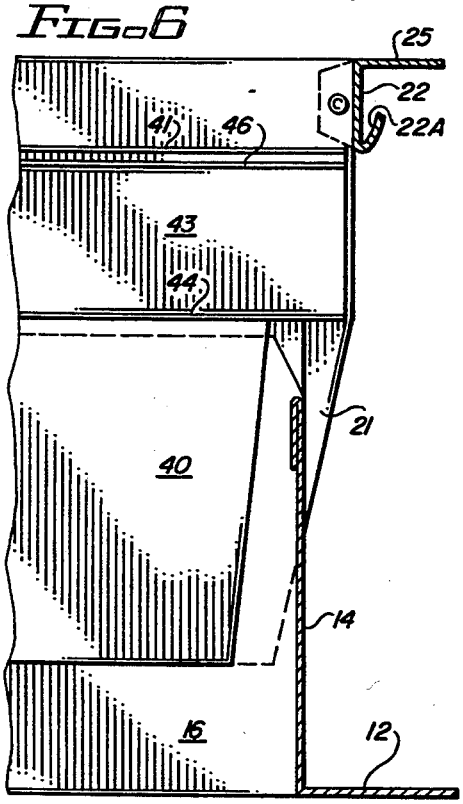

ADJUSTABLE ROOF JACK

BACKGROUND

Roof jacks, flashing plates or roof saddles have been used to provide a weather-tight cover over an opening through the roof of a building for stove pipes, vents, furnace pipes and air handlers. Typically, roof jacks include a portion attached to the roof and an upwardly extending portion, which is attached to a stove pipe vent, or the like. For air handlers, such as evaporative coolers, heat pumps, refrigeration units and the like, a portion of the roof jack is attached to the outlet duct of the air handler. Typically, roof jacks are made in a variety of angles for use with roofs having various standard pitches.

To reduce the inventory, which necessarily must be stocked for any particular type of roof jack, and, further, for permitting the use of roof jacks with non-standard roof pitches, adjustable roof jack assemblies or saddles have been designed. Six patents to Wallace U.S. Pat. No. 917,385; Dawson U.S. Pat. No. 1,192,279; McHale U.S. Pat. No. 1,332,224; Hoeft U.S. Pat. No. 1,703,670; Holtgreve U.S. Pat. No. 4,843,794; and Reaser U.S. Pat. No. 4,893,608, are directed to adjustable roof jacks for use with pipes extending up through the roof. In all of these patents, a base member which has a circular or spherical configuration is attached to the roof as the bottom portion of the jack. An upper cover member, having a complementary shape, is pivotally mounted on the base member; and the pipe or chimney extends through the upper member and is attached to it. The angle of pivot between the upper and lower members causes the devices to be usable on roofs of various pitches. In all cases, the lower or base member has a relatively wide slot in it compared to the opening in the top or upper member. The devices disclosed in all of these patents function in a comparable manner, with pivots located on opposite sides intermediate the upper and lower edges of the top member and attaching the top member to the lower member of the adjustable jack.

A different type of adjustable roof jack, more suitable for use with roof mounted air handlers such as evaporative coolers, air conditioners and heat pumps, is disclosed in the two patents to Sharp U.S. Pat. Nos. 4,526,091 and 4,781,401. The adjustable roof jack disclosed in both of these patents includes an upper member, which telescopes into a lower member, with the two members hinged together on the one end. The device of patent U.S. Pat. No. 4,526,091 is utilized as a roof jack between a roof mounted air handler and the roof, whereas the device of U.S. Pat. No. 4,781,401 is used to mount an air handler on top of an existing duct at a bend in the duct. The structure, however, disclosed in both of these patents for the adjustable jack is the same, with a bendable pivot or hinge being used on the front or uphill side of the device to pivot the two parts together.

A disadvantage with the roof jack assemblies utilizing circular or spherical parts is that the manufacture of parts in this shape is relatively complicated and expensive. The result is an assembly, which while it functions to provide the adjustability and weather resistant characteristics desired, cannot readily, inexpensively be made.

A significant disadvantage of the roof jack structures disclosed in the Sharp patent is that when the upper and lower units are hinged together at the front or upper side of the jack, only a relatively narrow range of adjustability for roofs of various pitches can be made from a single adjustable jack. Consequently, it has been necessary to provide an inventory of two or more jacks, each covering at least half of the range of pitches which can be encountered, in order to accommodate air handlers mounted on roofs of a wide range of varying pitches.

It is desirable to provide an adjustable roof jack which overcomes the disadvantages of the prior art listed above, which is readily manufactured from flat sheet stock material, and which is capable of a wide range of adjustment.

SUMMARY OF THE INVENTION

Accordingly it is an object of this invention to provide an improved adjustable roof jack.

It is another object of this invention to provide an improved adjustable roof jack capable of a wide range of adjustments.

It is still another object of this invention to provide an improved adjustable roof jack for installation between an opening in the roof of a building and an air handler mounted on the building roof.

It is an additional object of this invention to provide an improved adjustable roof jack capable of installation on a variety of roofs of different pitches.

It is a further object of this invention to provide an adjustable roof jack employing upper and lower rectangular boxes, which are pivotally interconnected together on opposite sides thereof to provide a wide range of adjustability.

In accordance with a preferred embodiment of this invention, an adjustable roof jack for interconnecting a roof-mounted air handler with a duct opening in a roof includes a first rectangular box-like member, which is attached over a duct opening in the roof. This first member has an open top and an open bottom with mutually perpendicular front, back, first and second sides. A second rectangular box-like member, also having an open top and an open bottom, is provided for attachment to the output of the air handler. This second box-like member has mutually perpendicular first and second sides and a front, all extending partially over the corresponding first and second sides and front of the first rectangular member, which is attached to the roof. A pivot interconnects the first sides of the first and second box-like members and a corresponding pivot interconnects the second sides of the first and box-like members at points intermediate the front and back of the first member to permit the second member to pivot from front-to-back relative to the first member. The depending edge of the front of the second member and the upper edge of the front of the first member, are slidably interconnected by causing one of these edges to be folded in a configuration to form a pocket, into which the edge of the other of these members extends. Thus, as the second member is pivoted relative to the first member, the edge of the one of the members extending into the pocket extends into the pocket to a greater or lesser extent, depending upon the angle of relative rotation between the two members.

BRIEF DESCRIPTION OF THE DRAWINGS

FIGS. 3A and 3B are partial cross-sectional views taken along the line 3A—3A of FIG. 1, illustrating two different relative positions of the parts of the invention shown in FIG. 1;

FIG. 6 is a partial cross-sectional view taken along the line 6—6 of FIG. 1;

FIG. 7 illustrates a feature of the embodiment shown in FIG. 1; and

FIG. 8 is a partial cross-sectional view similar to FIG. 6, with the part shown in FIG. 7 added.

DETAILED DESCRIPTION

Figure 1:
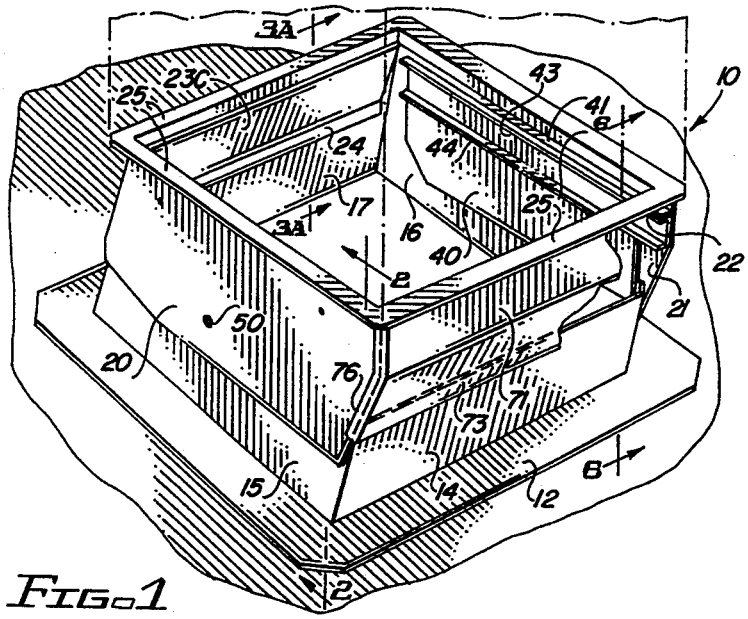
FIG. 1 a top perspective view of a preferred embodiment of the invention.

Reference now should be made to the drawing, in which the same reference numbers are used throughout the different figures to designate the same components.

Figure 4:
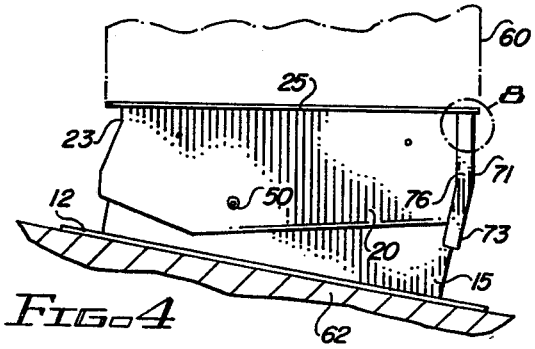
FIG. 4 is a diagrammatic side view of the embodiment of FIG. 1 installed on a roof of moderate pitch.
Figure 5:
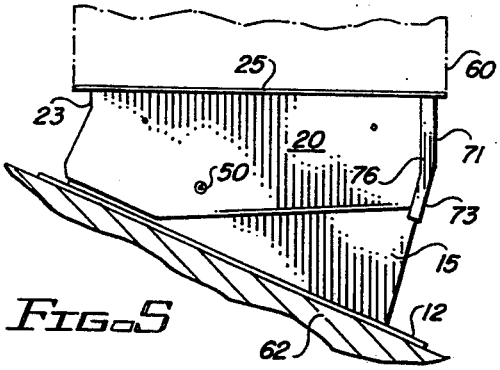
FIG. 5 is a diagrammatic side view of the embodiment of FIG. 1 installed on a roof of greater pitch than shown in FIG. 4.

FIG. 1 is a top perspective view of an adjustable roof jack in accordance with a preferred embodiment of the invention. This adjustable jack includes a bottom box-like member having an outwardly extending flange 12 on all four sides. The flange 12 is used to attach the bottom member to a roof 62 of a building (FIGS. 4 and 5). Extending upwardly from the flange 12 are four mutually perpendicular walls, including first and second side walls 15 and 16, a rear wall 14 and a front 17. These four walls are substantially of equal height, terminating in an upper edge. The lower edges of the walls 14, 15, 16 and 17 are connected to the flange 12 leaving an open bottom in the lower member. The upper edges of the walls 14, 15, 16 and 17 define an open top in this lower member. The lower member may be attached to the roof 62 in any suitable manner.

To provide for an adjustable angle roof jack, the upper member also comprises an open rectangular box-like device including a front 23 and first and second sides 20 and 21. The upper edges of the sides 20 and 21 are connected to an outwardly extending flange 25, which extends about the periphery of the open-ended box defined by the sides 20, 21 and 23. In addition, the rear edge of the box, immediately below the flange 25 on this edge, is formed by means of a downward projection 22 terminating in an upwardly-turned lip 22A (FIGS. 6 and 8).

The flange 25 is constructed for attachment to the lower side of an air handler around an air duct in the air handler. Such air handlers typically include evaporative coolers, air conditioning refrigeration units, and heat pumps designed to be mounted on the roof of a building. In the mounting of such air handlers on a building roof, the air handler unit is mounted horizontally, even though the roof beneath it slopes upwardly. To permit interconnection between the roof jack and the air handler, the plane of the surface defined by the flanges 25 must be capable of orientation at an angle to the plane of the surface defined by the flange 12, which is attached to the roof 62. To accomplish this, the sides 20 and 21 of the upper rectangular box member are pivotally attached to the corresponding sides 15 and 16 of the lower open-ended box member by means of a pair of opposing pivots 50 and 52, respectively. As is most readily apparent from an examination of FIGS. 3A, 3B, 4 and 5, the pivots 50 and 52 are located intermediate the front and back walls of the upper and lower boxes forming the adjustable roof jack. It also should be noted that the sides 20 and 21 of the upper box extend downwardly over the outside of the sides 15 and 16 of the lower member.

A similar construction is provided for an overlap of the front 23 of the top member or box over the upwardly extending front 17 of the lower unit or box. Because of the circular rotation which is effected about the pivots 50, however, the front 23 of the upper box includes a triple folded portion 23A, 23B and 23C (seen most clearly in FIGS. 3A and 3B) forming a generally "S" shaped configuration terminating in a lip 24. This folded portion 23A through 23C extends outwardly from the upper edge of the wall portion 23; so that the juncture of the upper part 23A with the downwardly extending portion 23 (again, see FIGS. 3A and 3B) is located at substantially the same distance from the pivots 50 and 52 as the lower edge of the fold where 23A is folded upwardly to become the portion 23B. Thus, as the upper unit is pivoted from the position shown in FIG. 3A to the position shown in FIG. 3B (and beyond), the radius of the circle which is subscribed by the upper and lower edges of the portion 23A tends to locate the upper edge of the front 17 of the lower unit snugly within the pocket formed between the portions 23B and 23C, as illustrated most clearly in FIG. 3B.

Figure 3A:
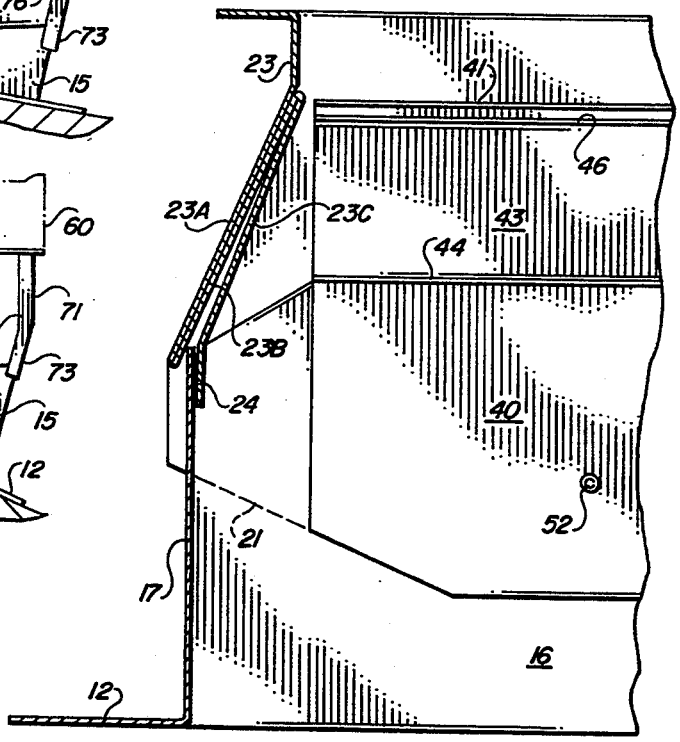

It also should be noted that the junction of the inwardly turned edge 24 with the portion 23C causes a tight sliding fit with the inside surface of the front 17 of the lower member or unit as the upper member is rotated counterclockwise (as viewed in FIGS. 3A and 3B) and then back again clockwise to the position shown in FIG. 3A. As this occurs, there is a slight spreading of the pocket formed between the folds 23B and 23C, which attains its maximum spread at approximately the midway point of the rotation from the position shown in FIG. 3A to the maximum counterclockwise position which can be attained. This intermediate position is shown in FIG. 3B. Continued counterclockwise rotation of the upper box unit relative to the lower unit, from the position shown in FIG. 3B, tends to cause the front wall 17 of the lower unit 3B to extend nearly parallel with the plane of the folds 23A and 23B. The result of the spring-like action of the galvanized sheet metal construction typically used for these box-like members causes a snug, weather-tight fit to be effected between the overlapping front walls of the upper and lower members.

Figure 2:
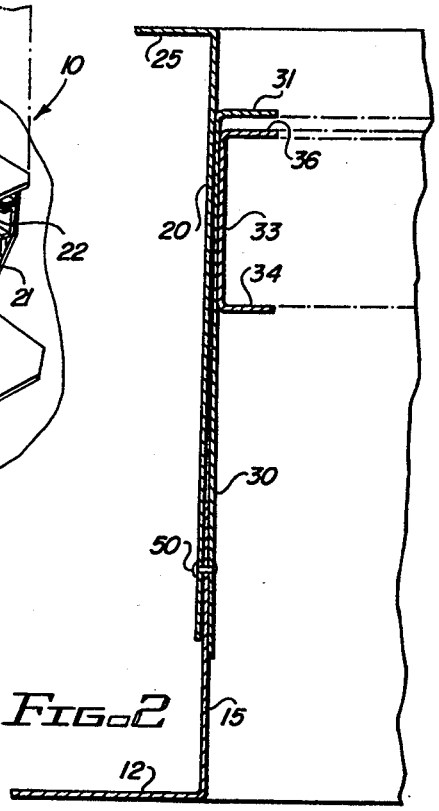
FIG. 2 is a partial cross-sectional view taken along the line 2—2 of FIG. 1.

As illustrated in FIG. 2, the upper member also has inner walls 30 and 40 attached near the upper edges to the corresponding outer side walls 20 and 21, terminating in inwardly-turned upper flanges 31 and 41, respectively. Spaced a short distance below the flanges 31 and 41 are a pair of elongated U-shaped channels 33 and 43, each having inwardly turned outer flanges 34 and 36 (for the channel 33) and 44 and 46 (for the channel 43). The orientation of these respective flanges is shown most clearly in FIGS. 1, 3, 6 and 8.

Since the lower lip 22A on the rear of the upper member is located above the flanges 31 and 41, the space between the upper edge of the rear wall 14 of the lower member and the lip 22 permits access through the rear of the unit to the channels formed between the flanges 31/41, 36/46, and 34/44. The wide channel formed by the U-shaped members 33 and 43 is used to permit the insertion of a suitable barometric damper, which frequently is used with units of this type. The narrow channels formed between the flanges 31/36 and 41/46 may be used for a slide-in solid metal damper of the type used for evaporative coolers during times of non-use. Of course, if an air handling unit is employed which does not need either a solid damper or a barometric damper in its operation, the space in the interior of the upper member may be left open, without placing any dampers in the channels, as illustrated in FIG. 1.

If no dampers are used, or once dampers are inserted into the device, a cover 71, 73 (shown most clearly in FIG. 7) is hooked in place over the lip 22A of the upper member to extend downwardly over the upper edge of the rear wall 14 of the lower member to close the space between the rear edge 22/22A and the rear wall 14 of the lower box unit, as illustrated in FIG. 8. A downwardly-extending hook or flange 72 is formed along the upper edge of the portion 71 of the cover; and a pair of sides 76 and 78, respectively, extend over the edge of the sides 20 and 21 of the upper unit. Once the cover is hooked in place and moved to the location shown in FIG. 8, a fastener, such as a sheet metal screw, is used to attach it to the rear wall 14 of the lower unit to secure it in place until it is necessary to remove it. It also should be noted that once the angular adjustment of the upper member relative to the lower member has been effected by attaching the flange 25 to the air handler and the flange 12 to the roof, sheet metal screws may be used to secure the sides 20 and 21 to the sides 15 and 16, respectively, if desired.

The construction of the inner walls 30 and 40 of the upper member, attached near their upper edges to the outer walls 20 and 21, forms a sandwich construction with the lower walls 15 and 16 of the lower member extending upwardly between the walls 20/30 and 21/40, as shown most clearly in FIG. 2. Also as shown in FIG. 2, the pivot pins 50 and 52 extend through all three of the sheet metal plates forming the walls, for example, 15, 20 and 30, as illustrated in FIG. 2, to facilitate the pivotal adjustment of the roof jack device. All of the parts of the roof jack, with the exception of the pivots 50 and 52 and the interconnections of the different sheet metal parts to one another, may be made of flat galvanized sheet steel of the type commonly used for air conditioning and heating ductwork.

By pivoting the upper member relative to the lower member at a point intermediate the front and back walls of the two members, a significantly greater range of adjustments may be effected than are possible where upper and lower units are pivoted along one edge, such as for example the front edge. The reason for this is that as the upper and lower members are pivoted from a flat (no pitch) configuration to any other pitch, the front of the top member is lowered relative to the front edge of the lower member, whereas the rear of the upper or top member is raised relative the lower member. This rocking action therefore causes a multiplication of the angular difference for the amount of linear movement of the front and rear portions of the upper and lower members relative to one another. The result is that in a commercial configuration of the unit shown in FIGS. 1 through 8, the adjustable roof jack may be used for a roof pitch variation extending from zero to a six-in-twelve roof pitch.

As is well known, the pitch of a roof is measured by resting a board at one end on the roof and then placing a level on the board; so that it extends outwardly horizontally from the roof. At a point twelve inches from the contact point of the board on the roof, the distance between the board and the roof is measured. If this distance, for example, is three inches, the pitch is 3-in-12. If this distance is six inches, the pitch is 6-in-12. In a commercial unit constructed in accordance with this invention, a full range of adjustability from a zero pitch to a 6-in-12 pitch is attainable (with sufficient room for a barometric damper) in a unit which is nine inches high when it is moved to its zero pitch orientation. This same unit then may be used for any variety of roof pitches between zero and 6-in-12, as described above; so that supply stores and contractors need only stock a single unit for installation on a variety of roofs of standard pitches. The result is a significant reduction in inventory requirements; and the roof jack is easy to adjust, and provides a good weather-tight installation once it is in place.

The foregoing description of the preferred embodiment of the invention should be considered as illustrative and not as limiting. Various changes and modifications will occur to those skilled in the art without departing from the true scope of the invention. For example, the particular relative locations of the pivot points may be varied, the inner walls 30 and 40 used to provide construction for the damper channels may be eliminated; and other variations may be effected for performing the substantially the same function, in substantially the same way, to achieve substantially the same result, without departing from the scope of the invention as defined in the appended claims.

I claim:

1. An adjustable roof jack for interconnecting a roof-mounted air handler with a duct opening in a roof, said roof jack including in combination:

a first rectangular box-like member for attachment over a duct opening in a roof, said first member having an open top and an open bottom with mutually perpendicular front, back and first and second sides;

a second rectangular box-like member having an open top for attachment to the output of an air handler and having an open bottom, a back, and at least mutually perpendicular first and second sides and a front extending partially over the corresponding first and second sides and front of said first rectangular member;

pivot members interconnecting said first sides of said first and second box-like members and interconnecting said second sides of said first and second box-like members at points intermediate the front and back of said first box-like member to permit said second box-like member to pivot from front to back relative to said first box-like member; and said front of one of said first and second box-like members has a folded configuration to form a pocket into which the front of said other of said first and second box-like members extends.

2. The adjustable roof jack according to claim 1 wherein said first rectangular box-like member has an outwardly extending flange on the bottom thereof for attachment to a roof, and wherein said second rectangular box-like member has outwardly extending flanges on the top thereof for attachment with an air handler.

3. The adjustable roof jack according to claim 2 wherein the first and second sides of said second box-like member each have a lower edge extending over the corresponding first and second sides of said first box-like member, and wherein at least a portion of said lower edges of said first and second sides of said second box-like member located between said pivot members and said front of said second box-like member slopes upwardly toward the top of said second box-like member.

4. The adjustable roof jack according to claim 3 further including first and second inner panels attached to said first and second sides, respectively, of said second box-like member at locations above said first and second sides of said first box-like member and extending over said first and second sides of said first box-like member for holding damper members thereon, said first sides of said first box-like member being sandwiched between said first side of said box-like member and said first inner panel, and said second side of said first box-like member being sandwiched between said second side of said second box-like member and said second inner panel.

5. The adjustable roof jack according to claim 4 further including a removable panel for attachment to the back of said second box-like member to extend downwardly over said back of said first box-like member.

6. The adjustable roof jack according to claim 5 wherein the front of said lower box-like member has an upper edge and said front of said second box-like member is folded in an "S" shaped fold wherein a lower first portion of said "S" fold extends downwardly on one side past the upper edge of said front of said first box-like member, with a second portion of said "S" fold of said front of said second box-like member extending above the upper edge of said front of said first box-like member whereupon a third portion of said "S" fold of said front of said second box-like member then extends downwardly past the upper edge of said front of said first box-like member on the opposite side thereof.

7. The adjustable roof jack according to claim 1 wherein said first and second sides of said second box-like member are of greater height at the back of said second box-like member than at the front of said second box-like member.

8. The adjustable roof jack according to claim 1 wherein the first and second sides of said second box-like member each have a lower edge extending over the corresponding first and second sides of said first box-like member, and wherein at least a portion of said lower edges of said first and second sides of said second box-like member located between said pivot members and said front of said second box-like member slopes upwardly toward the top of said second box-like member.

9. The adjustable roof jack according to claim 1 further including first and second inner panels attached to said first and second sides, respectively, of said second box-like member at locations above said first and second sides of said first box-like member and extending over said first and second sides of said first box-like member for holding damper members thereon, said first sides of said first box-like member being sandwiched between said first side of said box-like member and said first inner panel, and said second side of said first box-like member being sandwiched between said second side of said second box-like member and said second inner panel.

10. The adjustable roof jack according to claim 9 further including a removable panel for attachment to the back of said second box-like member to extend downwardly over said back of said first box-like member.

11. The adjustable roof jack according to claim 10 wherein the front of said lower box-like member has an upper edge and said front of said second box-like member is folded in an "S" shaped fold wherein a lower first portion of said "S" fold extends downwardly on one side past the upper edge of said front of said first box-like member, with a second portion of said "S" fold of said front of said second box-like member extending above the upper edge of said front of said first box-like member whereupon a third portion of said "S" fold of said front of said second box-like member then extends downwardly past the upper edge of said front of said first box-like member on the opposite side thereof.

12. The adjustable roof jack according to claim 11 wherein said first rectangular box-like member has an outwardly extending flange on the bottom thereof for attachment to a roof, and wherein said second rectangular box-like member has outwardly extending flanges on the top thereof for attachment with an air handler.

13. The adjustable roof jack according to claim 1 further including a removable panel for attachment to the back of said second box-like member to extend downwardly over said back of said first box-like member.

14. The adjustable roof jack according to claim 1 wherein the front of said lower box-like member has an upper edge and said front of said second box-like member is folded in an "S" shaped fold wherein a lower first portion of said "S" fold extends downwardly on one side past the upper edge of said front of said first box-like member, with a second portion of said "S" fold of said front of said second box-like member extending above the upper edge of said front of said first box-like member whereupon a third portion of said "S" fold of said front of said second box-like member then extends downwardly past the upper edge of said front of said first box-like member on the opposite side thereof.

* * * * *